United States Patent [19]

Avery, Jr.

[11] Patent Number: 4,570,458

[45] Date of Patent: Feb. 18, 1986

[54] METHOD AND APPARATUS FOR EXTRACTING LIQUID FROM A VAPOR COMPRESSION REFRIGERATION SYSTEM

[76] Inventor: Richard J. Avery, Jr., 5419 Mercedes, Dallas, Tex. 75206

[21] Appl. No.: 648,755

[22] Filed: Sep. 7, 1984

[51] Int. Cl.[4] ..... F25B 43/00

[52] U.S. Cl. ..... 62/503; 62/292

[58] Field of Search ..... 62/503, 292

[56] References Cited

U.S. PATENT DOCUMENTS

| | | | |
|---|---|---|---|
| 2,770,105 | 11/1956 | Colton | 62/503 |
| 3,180,567 | 4/1965 | Quiggle et al. | 62/503 |
| 3,225,554 | 12/1965 | Alexander | 62/292 |

FOREIGN PATENT DOCUMENTS

| | | | |
|---|---|---|---|
| 154850 | 12/1979 | Japan | 62/503 |

*Primary Examiner*—Ronald C. Capossela
*Attorney, Agent, or Firm*—Hubbard, Thurman, Turner & Tucker

[57] ABSTRACT

Liquid is extracted from a vapor compression refrigerant flow circuit utilizing a compressor suction line accumulator having a sump portion and boss formed thereon for receiving a device for extracting liquid from the sump of the accumulator. The device includes a curved tube and shutoff valve connected thereto and wherein the tube has a compression sleeve type tube connector and nut assembly secured thereto at a predetermined point on the tube so that the fluid inlet end of the tube may be inserted into the interior of the vessel containing the sump and oriented such that any liquid in the sump is assured of being forced out through the tube and the shutoff valve during steady state operation of the system. Contaminants in the form of excess compressor lubricant or tracer liquids may be extracted from the system during steady state operation and the system may be pumped down to isolate the refrigerant fluid on the condenser or high pressure side during insertion of and removal of the liquid extraction device with respect to a vessel on the low pressure side of the refrigerant flow circuit.

10 Claims, 2 Drawing Figures

METHOD AND APPARATUS FOR EXTRACTING LIQUID FROM A VAPOR COMPRESSION REFRIGERATION SYSTEM

BACKGROUND OF THE INVENTION

1. Field of the Invention

The present invention pertains to a removable valve and conduit assembly for use in extracting excess lubricant from a sump formed in an accumulator, compressor or other vessel in a vapor compression refrigeration system.

2. Background

In vapor compression refrigeration systems compressor lubricant is sometimes circulated through the refrigerant flow circuit to assure that certain working parts of the compressor are adequately lubricated during operation thereof. More often, the lubricant is unavoidably introduced into the refrigerant flow circuit from the cylinder walls of reciprocating piston type compressors, for example. Moreover, in certain instances a tracer liquid is injected into the refrigerant flow circuit for detection of leaks in the system. However, it is not unusual to overcharge a system with compressor lubricant or with a tracer liquid which can interfere with the efficient operation of vapor compression refrigeration systems and in extreme cases result in severe damage to the compressor due to ingestion of excessive amounts of liquid into the compression chambers.

Although it is possible to provide a drain cock in the refrigerant flow circuit at some point, many systems do not have a convenient point for locating such a device, and it is considered undesirable to leave an easily openable valve in the system whereby such a valve may be inadvertently opened resulting in loss of refrigerant fluid. Accordingly, there has been a need for an arrangement in a vapor compression refrigeration system wherein a sump is provided at a preferred location in the refrigerant flow circuit and wherein excessive amounts of liquid, usually compressor lubricant, may be extracted from the system at this sump by the insertion of a liquid extraction device which may be temporarily connected to the system. Such an extraction device is preferably connected to an accumulator vessel having a sump located such that the device will extract substantially all liquid which has collected in the accumulator sump. These desiderata have been accomplished with the refrigeration system and device in accordance with the present invention.

SUMMARY OF THE INVENTION

The present invention provides for an improved method of extracting excess compressor lubricant and other liquids from vapor compression refrigeration systems wherein a vessel is interposed in the refrigerant flow circuit and provides a sump and a suitable fitting for the insertion of a liquid extraction device into the vessel whereby excess liquid collected in the sump may be extracted from the system. The present invention also provides a convenient means for removing lubricant samples from a vapor compression refrigeration system for analysis or inspection of the lubricant.

In accordance with one aspect of the present invention a vapor compression refrigeration system is provided with an accumulator vessel having a sump and a fitting formed in a sidewall of the vessel which is operable to receive a unique liquid extraction device comprising a curved conduit connected to a valve and to a fitting which provides for connecting the conduit to the accumulator vessel and for locating the conduit such that the liquid inlet end of the conduit is properly positioned in the sump.

In accordance with another aspect of the present invention there is provided a device for insertion in a pressure vessel of a vapor compression refrigeration system for extraction of liquid from the system. The device is configured to be properly oriented to withdraw liquid from a sump of the pressure vessel and wherein the device may be removed from the vessel so that a fusible plug or other insert may be connected to the vessel in place of the extraction device.

Those skilled in the art will recognize the above mentioned features and advantages of the present invention as well as other superior aspects thereof upon reading the detailed description which follows in conjunction with drawing.

DESCRIPTION OF THE PREFERRED EMBODIMENTS

Figure 1:
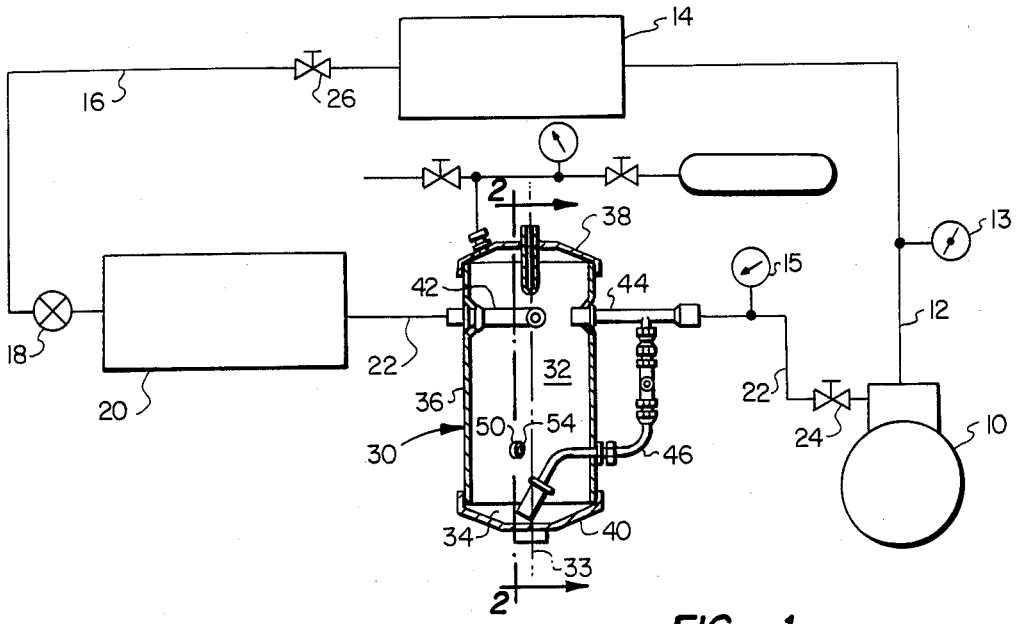
FIG. 1 is schematic diagram of a vapor compression refrigeration system having a compressor suction line accumulator vessel disposed therein and of a type used in conjunction with the method and apparatus of the present invention.

In the description which follows like parts are marked throughout the specification and drawing with same reference numerals, respectively. The drawing figures are not necessarily to scale and certain features of the invention are shown exaggerated in scale or in schematic form in the interest of clarity.

Referring to FIG. 1, there is illustrated a schematic diagram of a typical vapor compression refrigeration system comprising a compressor 10 connected to a refrigerant flow circuit including a compressor discharge conduit 12 leading to a refrigerant condenser 14. The refrigerant flow circuit includes a liquid refrigerant line 16 leading from the condenser 14 to an expansion device 18 whereby liquid refrigerant is expanded and flashed to vapor in an evaporator 20. The refrigerant flow circuit further includes a low pressure refrigerant conduit 22 leading from the evaporator 20 back to the suction or inlet side of the compressor 10. Typically, the circuit includes a manually actuatable shutoff valve 24 interposed in the conduit 22 between the compressor 10 and evaporator 20 and a second manually actuatable shutoff valve 26 disposed in the liquid refrigerant line downstream, of the condenser 14.

The refrigeration system illustrated in FIG. 1 preferably includes a suction line accumulator vessel interposed in the conduit 22 and generally designated by the numeral 30. The accumulator 30 is preferably of a type described and claimed my U.S. patent application Ser. No. 421,882, filed Sept. 23, 1982 now U.S. Pat. No. 4,474,034. A vessel having a similar separation chamber and sump but otherwise of another configuration may be used in conjunction with the present invention. The accumulator vessel 30 is preferably disposed upright in the position illustrated in FIG. 1 and includes a liquid separation chamber 32 a lower portion of which forms a liquid collection sump 34. The chamber 32 and sump 34 are defined by the accumulator vessel 30 which has a generally cylindrical sidewall 36 and top and bottom closure heads 38 and 40. Refrigerant fluid and any liquids entrained therein are introduced into the separation chamber 32 by an inlet conduit portion 42, and a vapor discharge conduit 44 opens into the chamber 32 above the sump 34. A secondary fluid discharge line 46 is interconnected between the sump 34 and the primary discharge conduit 44 for monitoring the flow of refrigerant fluid through the accumlator 30 in accordance with the teaching of the invention in the above mentioned patent application.

Figure 2:
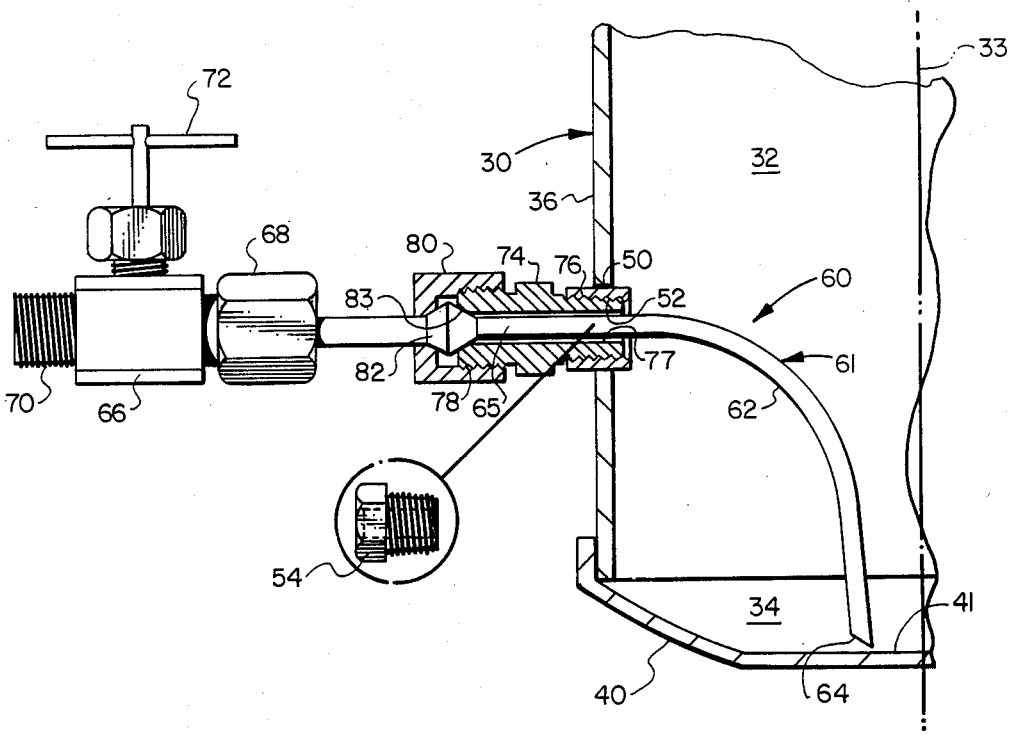
FIG. 2 is a detailed section view taken generally along the line 2—2 of FIG. 1 and showing the liquid extraction device installed in its working position in the accumulator vessel.

The accumulator vessel 30 is also provided with a boss 50 formed in the sidewall 36, FIG. 2 also, and suitably threaded at 52 with internal, standard pipe threads and for receiving a fusible plug 54, FIG. 1, in compliance with certain regulations regarding the operating safety of vapor compression refrigeration systems. Plug 54 is threadedly disposed in the boss 50 and may be removed using a conventional wrench or the like.

As mentioned above, vapor compression refrigeration systems, depending on the type of compressor used, usually tend to accumulate compressor lubricant in or purposely have at least a trace amount of lubricant circulating with the refrigerant through the refrigerant flow circuit including the conduits leading from the compressor to and through the condenser, expansion device, evaporator and back to the compressor. In systems using reciprocating piston-type compressors, for example, lubricant tends to accumulate and circulate through the system. In certain other types of compressors lubricant is purposely mixed with the refrigerant vapor during the compression process and is separated downstream of the compressor and recirculated back to the compressor for reinjection into the compression chambers. A certain percentage is unavoidably carried with the refrigerant vapor past the separator and into the refrigerant flow circuit. Moreover, in certain vapor compression refrigeration systems it is often necessary to inject a certain amount of a tracer liquid, normally an oil dyed to provide a distinguishing color, which is used for detection of leaks. It is desirable, however, to minimize the amount of compressor lubricant, tracer liquid or other unwanted liquids in the refrigerant flow circuit to enable the system to operate more efficiently. Prior art types of vapor compression refrigeration systems have lacked a suitable method and apparatus for use in extraction of these unwanted liquids from the refrigerant flow circuit prior to the development of the present invention.

Referring to FIG. 2, the present invention contemplates the provision of a liquid extraction device, generally designated by the numeral 60, and characterized by a metal tube or conduit 61 including a curved section 62 having a liquid inlet end 64 which is preferably scarfed as illustrated with respect to the longitudinal axis of the tube. The tube 61 is bent at substantially right angles from the scarfed inlet end 64 to a section 65 leading to a shutoff valve 66. The straight tube section 65 is suitably connected to the valve 66 through a conventional tube fitting assembly including a nut 68. The tube section 65 may be flared at its distal end, not shown, or provided with a compression fitting, also not shown, depending on the type of fitting structure formed by the valve 66 and the cooperating nut 68. The valve 66 may be a conventional gate or needle type valve having a connector portion 70 for connecting the device 60 to a conduit, not shown. The valve 66 includes an operating handle 72 for opening and closing the aforementioned gate or needle closure structure.

In accordance with the present invention it is important that the inlet end 64 of the conduit 61 be located near the bottom of the sump 34 as defined by the closure head 40 so that substantially all liquid can be removed from the sump through the device 60. In this regard the inlet end 64 is located relative to the sidewall 36 and the boss 50 by a fitting assembly comprising a connector member 74 which is of the tapered sleeve compression type having external pipe threads 76 formed on one end thereof and external machine threads 78 formed on the other end thereof. The connector 74 includes a bore 77 slightly large in diameter than the diameter of the tube or conduit section 65. A cooperating nut 80 is disposed around the tube section 65 and is operable to form a fluid tight connection with the connector 74 through a tapered sleeve 82. The connector 74, nut 80 and sleeve 82 may conform to SAE (Society of Automotive Engineers) standards for tapered sleeve compression type tube fittings. By locating the sleeve 82 at a predetermined point along the tube section 65 relative to the inlet end 64 and precompressing the sleeve to crimp it into fixed forcible engagement with the tube section 65 any use of the device 60 in conjunction with an accumulator vessel 30 of known dimensions will automatically locate the inlet end 64 of the tube 61 when the device is assembled to the vessel 30 as illustrated in FIG. 2. The rotational orientation of the tube 61 is determined by placing the valve 66 such that its operating handle 72 lies in the same plane as the curved section 62 of the tube whereby the user may know that, when the valve handle 72 is upright or aligned with the longitudinal axis 33 of the vessel 30, the tube inlet end 64 is pointing substantially straight downward, viewing FIG. 2, or substantially coplanar with the longitudinal central axis of the accumulator vessel 30.

The method of extracting excess liquid and the operation of the extraction device 60 will now be described. If it has been determined that possibly excess compressor lubricant or other liquids are present in the refrigerant flow circuit of a vapor compression refrigeration system, such as that illustrated in FIG. 1, valve 26 may be closed while operating the compressor 10 to pump substantially all of the refrigerant fluid into the compressor discharge line and the flow circuitry of the condenser 14. Gauges 13 and 15 in the circuit as illustrated may be monitored to determine the status of the pumping of the refrigerant fluid into the portion of the circuit delimited by the valve 26 and the compressor 10. The valve 24 may be closed, upon shutting down the compressor 10, to trap the fluid in the circuit between the valves 24 and 26.

If the pressure gauge 15 indicates that the pressure in the vessel 30 is approximately atmospheric or only slightly above the fusible plug 54 may be removed from the vessel 30 and the liquid extraction device inserted through the bore of the boss 50, which is of sufficient diameter to permit entry of the curved portion 62 of the conduit or tube 61. The device 60 is then oriented so that the inlet end 64 is adjacent to the inner wall surface 41 of the closure head 40 and the connector fitting 74 is then threadedly engaged with the boss 50 and tightended. Finally, the conduit 61 is precisely located by tightening the nut 80 against the sleeve 82 to sealingly engage the sleeve 82 with a cooperating surface 83 on the connector 74. The device 60 is now securely locked in place and sealingly engaged to prevent unwanted leakage of refrigerant fluid out of the chamber 82 except as controlled by the valve 66. Valves 24 and 26 may now be opened to allow refrigerant fluid to circulate through the system and the compressor operated to pump refrigerant fluid therethrough.

When steady state load conditions on the evaporator and condenser are reached, and preferably a certain amount of superheat is imparted to the refrigerant vapor exiting from the evaporator, the valve 66 may be periodically opened to extract any liquid accumulating in the sump 34. The system illustrated in FIG. 1 is preferably operated with a substantial load on the evaporator 20 to assure that liquid refrigerant is not entering the sump 34 and that therefore only liquid which is desired to be withdrawn from the circuit is picked up through the tube 61. The pressures in the refrigerant flow circuit are normally sufficient in the chamber 32 to force liquid through the conduit 61 to a suitable point of discharge, not shown.

After a suitable period of time and indication that no excess liquid is present in the refrigerant flow circuit the valve 26 is again closed to permit pumping the refrigerant fluid into the portion of the circuit which includes the compressor 10 and between the valves 26 and 24 so that the pressure in the chamber 32 may be reduced sufficiently to permit removal of the device 60 from the accumulator vessel 30. The device 60 is normally removed by loosening the nut 80 and then unthreading the connector 74 from the boss 50, then withdrawing the tube 61 from the chamber 32 and replacing the fusible plug 54 in the boss 50. The valves 24 and 26 may then be opened to restore the system to its normal working condition. Of course, the device 60 may be left intact with the vessel 30 in its working position although, if a boss which normally receives a fusible plug is used as a point of entry into the chamber 32 by the device 60, the device should be removed and the fusible plug replaced as required by regulations for the operation of vapor compression refrigeration systems.

Although preferred embodiments of the method and apparatus of the present invention have been described herein those skilled in the art will recognize that various substitutions and modifications may be made to the specific structure and method steps disclosed without departing from the scope and spirit of the invention as recited in the appended claims.

What I claim is:

1. A device for use in a vapor compression refrigeration system having a refrigerant flow circuit including a compressor, condenser, evaporator and a vessel forming a liquid sump interconnected by refrigerant flow line means, said vessel being located in said circuit between said evaporator and said compressor, and said vessel including a boss and a removable plug closing an opening in said boss, said device comprising:

a substantially rigid fluid conduit having an inlet end;

valve means connected to said conduit for closing said conduit to fluid flow;

connector means disposed on said conduit for connecting said conduit to said vessel at said boss and for orienting said conduit in such a way that said inlet end is disposed in said sump to conduct liquids accumulating in said sump out of said circuit through said valve means; and means on said conduit cooperable with said connector means for locating said conduit in a fixed predetermined position relative to said sump when said connector means is secured to said boss.

2. The device set forth in claim 1 wherein:

said connector means comprises a connector body having a first threaded portion for connection to said boss and a second threaded portion opposed to said first threaded portion for connection to a nut disposed on said conduit, and said means on said conduit is disposed between said connector means and said nut when said connector means is secured to said nut.

3. The device set forth in claim 2 wherein:

said means on said conduit comprises a compression sleeve secured to said conduit at a predetermined point on said conduit, said compression sleeve being adapted for sealing engagement with said connector means.

4. The device set forth in claim 3 wherein:

said conduit is rotatable relative to said connector means for orienting the inlet end of said conduit in said sump.

5. The device set forth in claim 4 wherein:

said conduit is curved between said compression sleeve and said inlet end.

6. The device set forth in claim 5 wherein:

said valve is oriented in a predetermined direction relative to the plane of curvature of said conduit.

7. The device set forth in claim 6 wherein:

said inlet end is scarfed to provide an opening for fluid to flow into said conduit.

8. A method for extracting excess lubricant, lubricant samples and other liquids from a vapor compression refrigeration system having a refrigerant flow circuit including a compressor, a condenser, and an evaporator interconnected by refrigerant flowline means; said method comprising the steps of:

providing an accumulator comprising a closed pressure vessel forming a liquid sump and including a boss and a removable plug for closing an opening in said boss, locating said pressure vessel in said circuit between said evaporator and said compressor;

providing a liquid extraction device comprising a substantially rigid fluid conduit having an inlet end, valve means connected to said conduit for closing said conduit to fluid flow and connector means disposed on said conduit for connecting said conduit to said vessel at said boss and for orienting said conduit in such a way that said inlet end is disposed in said sump;

reducing the pressure of refrigerant fluid in said vessel and removing said plug from said boss;

inserting said conduit through said boss and orienting said conduit with said inlet end in said sump;

operating said system to circulate refrigerant therethrough; and opening said valve means to extract liquid from said sump until the desired quantity of liquid is removed from said system.

9. The method set forth in claim 8 including the steps of:

reducing the pressure of refrigerant fluid in said vessel after extraction of liquid therefrom;

removing said conduit from said sump; and replacing said plug in said boss to close said vessel.

10. The method set forth in claim 9 wherein:

said pressure is reduced in said vessel by pumping refrigerant fluid into a closed portion of said system.

* * * * *